US012662770B2

(12) United States Patent
Yeom et al.

(10) Patent No.: US 12,662,770 B2
(45) Date of Patent: Jun. 23, 2026

(54) CLOTHES DRYER WITH A DRUM GASKET

(71) Applicant: SAMSUNG ELECTRONICS CO., LTD., Suwon-si (KR)

(72) Inventors: Changbae Yeom, Suwon-si (KR); Youngjae Kim, Suwon-si (KR); Jaeik Cha, Suwon-si (KR); Yeonwoo Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 780 days.

(21) Appl. No.: 18/070,692

(22) Filed: Nov. 29, 2022

(65) Prior Publication Data

US 2023/0125016 A1 Apr. 20, 2023

Related U.S. Application Data

(63) Continuation of application No. PCT/KR2021/003703, filed on Mar. 25, 2021.

(30) Foreign Application Priority Data

Jun. 19, 2020 (KR) ..... 10-2020-0074798
Aug. 27, 2020 (KR) ..... 10-2020-0108321

(51) Int. Cl.
*A61L 2/00* (2006.01)
*A61L 2/04* (2006.01)
(Continued)

(52) U.S. Cl.
CPC ..... *D06F 58/06* (2013.01)

(58) Field of Classification Search
CPC ..... D06F 58/04; D06F 58/06; D06F 58/20; D06F 37/28
(Continued)

(56) References Cited

U.S. PATENT DOCUMENTS 3,047,187 A * 7/1962 Taylor ..... D06F 58/04 34/601
4,467,534 A * 8/1984 Murase ..... D06F 58/02 34/140
5,363,569 A * 11/1994 Kadakia ..... D06F 58/04 34/601
(Continued)

FOREIGN PATENT DOCUMENTS

CN 101377053 B 5/2011
EP 1 790 768 A2 11/2006
(Continued)

OTHER PUBLICATIONS

English translation EP3130701 by PE2E, Aug. 8, 2025.*
(Continued)

*Primary Examiner* — Deming Wan
(74) *Attorney, Agent, or Firm* — STAAS & HALSEY LLP

(57) ABSTRACT

A clothes dryer including an improved gasket structure to improve a drying performance. The clothes dryer includes a cabinet, a drum rotatable inside the cabinet, a frame positionable between the cabinet and the drum to support the drum, and a gasket positionable between the drum and the frame. The gasket includes a first member to couple an inlet member of the drum to a vertical surface of the frame while the first member is in contact with the vertical surface of the frame so as to limit a horizontal movement of the drum, and a second member to couple the inlet member of the drum to a horizontal surface of the frame while the second member elastically supports the inlet member of the drum on the horizontal surface of the frame so as to limit a vertical movement of the drum.

14 Claims, 10 Drawing Sheets

(51) Int. Cl.

| | |
|---|---|
| ***A61L 2/10*** | (2026.01) |
| ***D06F 58/06*** | (2006.01) |
| ***F26B 5/04*** | (2006.01) |
| ***F26B 5/06*** | (2006.01) |

(58) Field of Classification Search
USPC ..... 34/242, 603, 601; 68/23 A, 139
See application file for complete search history.

(56) References Cited

U.S. PATENT DOCUMENTS

| | | | | |
|---|---|---|---|---|
| 2007/0130790 | A1 | 6/2007 | Jung | |
| 2018/0023242 | A1* | 1/2018 | Kang | D06F 58/20 34/595 |
| 2020/0399819 | A1 | 12/2020 | Lee et al. | |

FOREIGN PATENT DOCUMENTS

| | | | | |
|---|---|---|---|---|
| EP | 3130701 | A1 * | 2/2017 | D06F 58/04 |
| JP | 9-220400 | A | 8/1997 | |
| JP | 9-225197 | A | 9/1997 | |
| KR | 10-0619728 | B1 | 9/2006 | |
| KR | 10-2007-0060931 | A | 6/2007 | |
| KR | 10-2008-0010702 | A | 1/2008 | |
| KR | 10-1073031 | B1 | 10/2011 | |
| KR | 10-1708655 | B1 | 2/2017 | |
| KR | 10-1953334 | B1 | 5/2019 | |
| KR | 10-2019-0101574 | A | 9/2019 | |
| KR | 10-2019-0128490 | A | 11/2019 | |

OTHER PUBLICATIONS

International Search Report issued in International Application No. PCT/KR2021/003703 dated Jul. 12, 2021.

International Written Opinion issued in International Application No. PCT/KR2021/003703 dated Jul. 12, 2021.

Korean Office Action dated Jul. 12, 2025 for Korean Patent Application 10-2020-0108321.

* cited by examiner

CLOTHES DRYER WITH A DRUM GASKET

CROSS-REFERENCE TO RELATED APPLICATION(S)

This application is a continuation application, under 35 U.S.C. § 111(a), of international application No. PCT/KR2021/003703, filed on Mar. 25, 2021, which claims priority to Korean Patent Application No. 10-2020-0074798, filed on Jun. 19, 2020, and Korean Patent Application No. 10-2020-0108321, filed Aug. 27, 2020, in the Korean Intellectual Property Office, the disclosures of which are incorporated by reference herein in their entirety.

BACKGROUND

1. Field

The disclosure relates to a clothes dryer, and more particularly, to a clothes dryer including an improved gasket structure to improve a drying performance.

2. Description of Related Art

In general, a clothes dryer is a home appliance for drying a wet object, and the clothes dryer may dry an object inside a drum by allowing hot air to pass through the drum while rotating the drum in which the object to be dried is accommodated.

The clothes dryer may include a drum that is rotatably installed, a driving device configured to drive the drum, a blower configured to blow air into the rotating drum, and a heater configured to heat the air.

When the clothes dryer is operated after an object to be dried is put into the drum, the drum is rotated by the operation of the driving device and hot air is supplied into the drum by the operation of the heater and the blower.

The clothes dryer may further include a front support frame provided to support the drum from the front. When airtightness between the front support frame and the drum is poor, water vapor or lint may leak between the front support frame and the drum. The leakage of water vapor or lint may not only reduce a drying performance of the clothes dryer, but may also cause accidents such as fire.

Further, because the high-temperature air leaks, energy for heating the air or energy for restoring a rotational force of the drum that is lowered due to excessive friction between a gasket and the drum may be additionally required, thereby reducing energy efficiency.

Accordingly, when a sealing function of the gasket is reduced, the performance of the clothes dryer is not consistent, and there is a difficulty in that the energy consumption is also not constant.

SUMMARY

One aspect of the present disclosure provides a clothes dryer including a cabinet, a drum rotatable inside the cabinet, a frame positionable between the cabinet and the drum to support the drum, and a gasket positionable between the drum and the frame. The gasket includes a first member to couple an inlet member of the drum a vertical surface of the frame while the first member is in contact with the vertical surface of the frame so as to limit a horizontal movement of the drum, and a second member to couple the inlet member of the drum to a horizontal surface of the frame while the second member elastically supports the inlet member of the drum on the horizontal surface of the frame so as to limit a vertical movement of the drum.

The first member may include a first pad coupleable to the frame and including at least one of elastic rubber, ethylene propylene diene monomer (EPDM) rubber, and silicone rubber, and a second pad coupleable to the first pad to allow a front end of the drum to be in contact therewith and including a fabric material.

The second member may include at least one of elastic rubber, EPDM rubber, and silicone rubber.

The second member may include a first body to be in contact with the horizontal surface of the frame, and a second body which extends from the first body, where the second body is above the first body and is moveable relative to the first body.

The second member may further include a hollow member which is positionable between the first body and the second body, while the first member is in contact with the vertical surface of the frame and the second member supports the inlet member of the drum, to maintain a reaction force of the drum.

The hollow member may include a protrusion formed on at least one of the first body and the second body, and a hollow body, on at least another of the first body and the second body to face the protrusion, and including a hollow formed in the hollow body.

The second member may include a hinge to allow the first body and the second body to be connected to each other and to allow the second body to move relative to the first body.

The second member may further include a connection body which extends upwardly from the first body to connect between the first body and the second body, and the hinge may be provided on the connection body.

The first pad and the second pad may be coupleable to each other by an adhesive method.

The gasket may further include a third member to be connected to the second member and be supported in surface contact with at least a portion of an inner surface of the drum. The third member may include a fabric material.

The third member may be arranged to overlap an upper surface of the second body.

The first member may be coupleable to the second member through a first connection member, and the first connection member may enable the second body to move relative to the first body.

The third member may be coupleable to the second member through a second connection member. The second connection member may enable the second body to move relative to the first body, and the second connection member is behind the first connection member along a rotation axis direction of the drum.

The frame may further include a gasket mounting member to which the gasket is mountable, and a separation prevention member which protrudes from the horizontal surface of the frame to prevent the gasket from being separated from the gasket mounting member.

Another aspect of the present disclosure provides a clothes dryer including a cabinet, a drum rotatable inside the cabinet, a frame positionable between the cabinet and the drum to support the drum, and a gasket positionable between the drum and the frame. The gasket includes a first member to couple a front end of the drum to the frame and be supported thereon so as to limit a horizontal movement of the drum, a second member connectable to the first member and to allow at least a portion of an inner surface of the drum to be elastically supported thereon, so as to limit a vertical movement of the drum, and a hollow member provided in the second member and including a hollow for maintaining a vertical reaction force of the drum.

The second member may include a first body to be in contact with the frame, a second body which extends from the first body and be positioned above the first body, and a hinge to allow the first body and the second body to be connected to each other and to allow the second body to move relative to the first body.

The hollow member may include a protrusion formed on at least one of the first body and the second body, and a hollow body on at least another of the first body and the second body to face the protrusion and including the hollow formed in the hollow body.

The protrusion may protrude from at least one of the first body and the second body to vertically press the hollow body.

The gasket may further include a third member connected to the second member and provided to be supported in surface contact with at least a portion of the inner surface of the drum. The third member may include a fabric material.

The third member may be arranged to overlap an upper surface of the second body.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
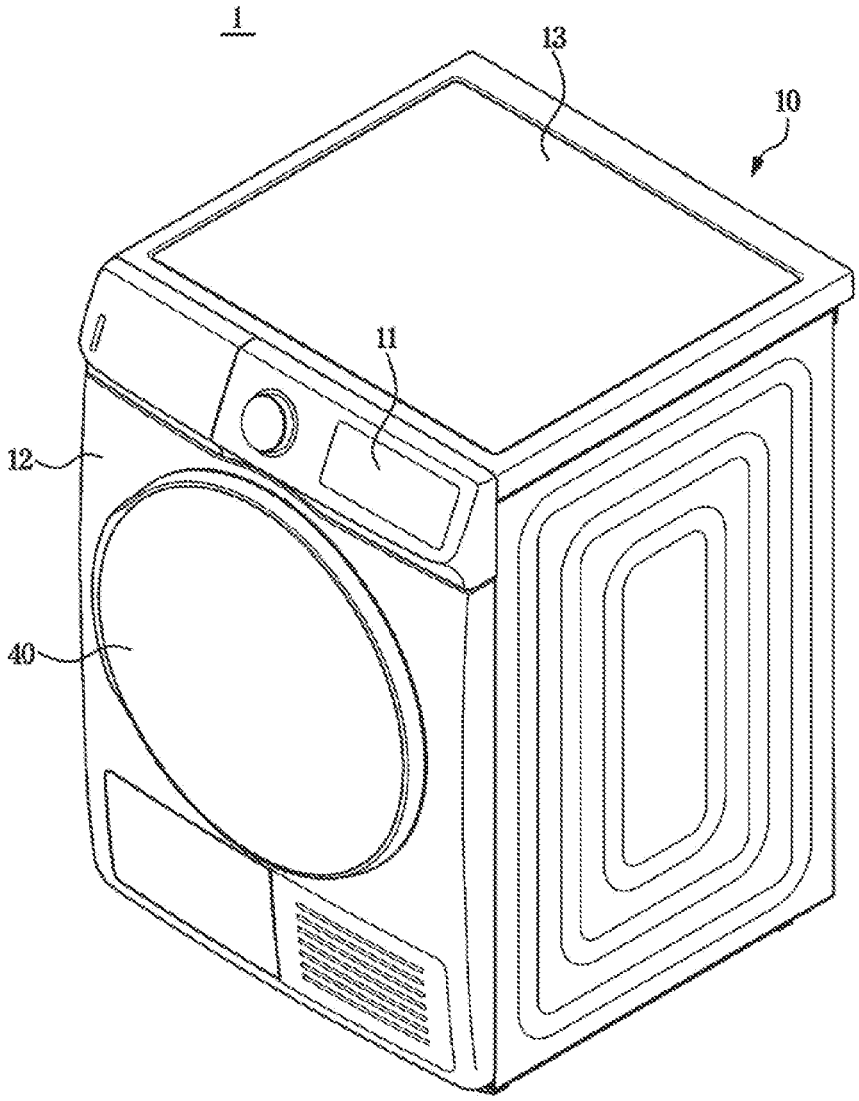
FIG. 1 is a perspective view illustrating a clothes dryer according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

Therefore, it is an aspect of the disclosure to provide a clothes dryer including an improved gasket structure to improve airtightness between a drum and a front support frame.

It is another aspect of the disclosure to provide a clothes dryer including a gasket capable of consistently maintaining a performance of the clothes dryer and improving an energy efficiency.

Figure 2:
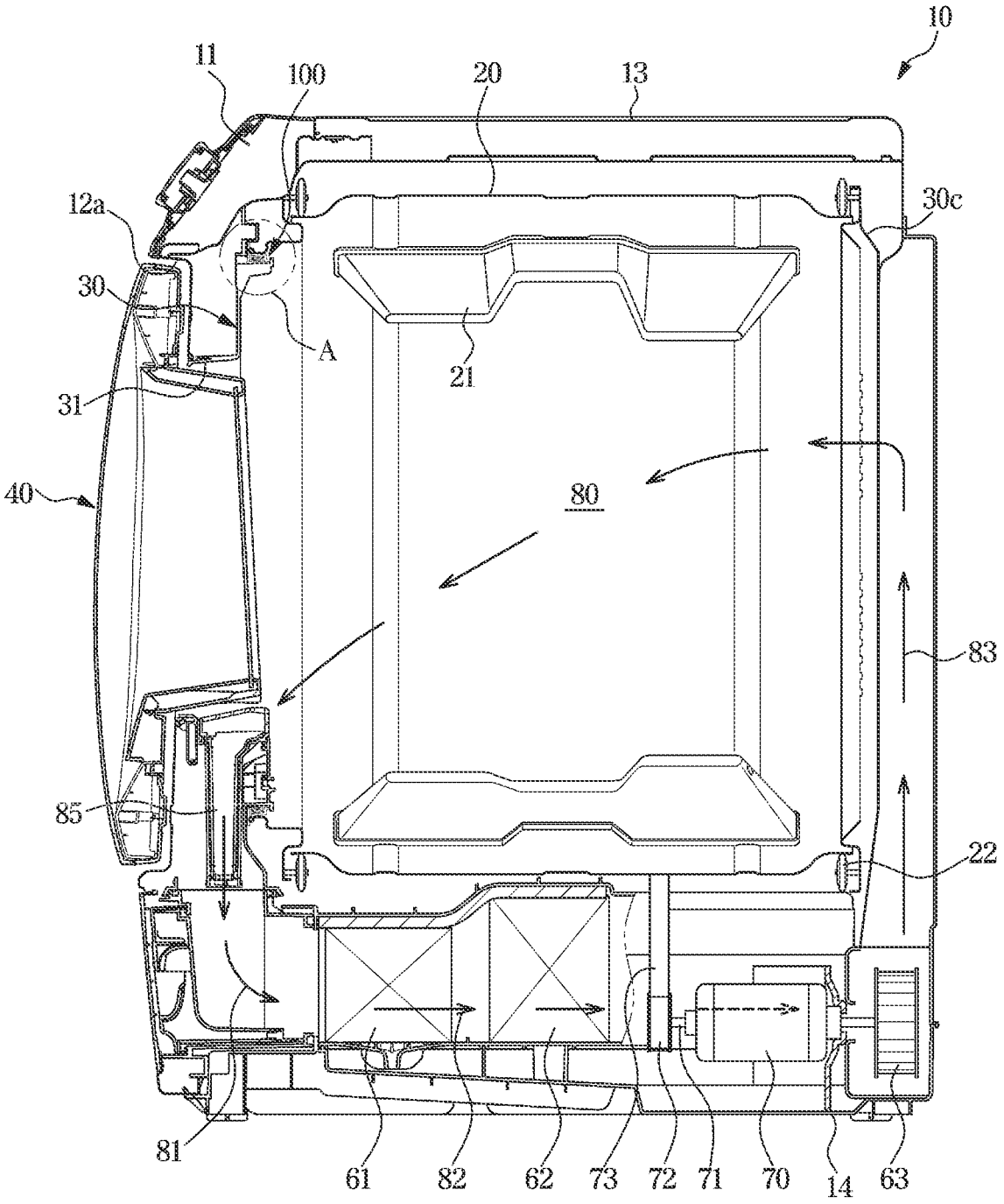
FIG. 2 is a cross-sectional view illustrating the clothes dryer according to an embodiment of the disclosure.

FIG. 1 is a perspective view illustrating a clothes dryer according to an embodiment of the disclosure, and FIG. 2 is a cross-sectional view illustrating the clothes dryer according to an embodiment of the disclosure.

As illustrated in FIGS. 1 and 2, a clothes dryer 1 may include a cabinet 10 forming an exterior of the clothes dryer 1 and a drum 20 rotatably installed in the cabinet 10.

The cabinet 10 may be formed in a substantially hexahedral shape. An inlet 12*a* provided to insert or withdraw clothes (not shown), which is an object to be dried, into or from the drum 20 may be formed on a front surface of the cabinet 10. The inlet 12*a* may be opened and closed by a door 40.

A control panel 11 configured to control an operation of the clothes dryer 1 may be provided on an upper front side of the cabinet 10. An inputter formed in the form of a rotatable jog dial to receive an operation of the clothes dryer 1, and a display provided to display various information regarding the clothes dryer 1 may be provided in the control panel 11. However, the disclosure is not limited thereto, and the control panel may include various types of inputters and displays.

The drum 20 having a cylindrical shape may be provided inside the cabinet 10. The drum 20 may be configured to be rotated by receiving power from a driving device. The driving device configured to rotate the drum 20 will be described later.

The cabinet 10 may include a front cover 12 forming a front surface, a top cover 13 forming an upper surface, and a base (not shown) forming a bottom surface. According to an embodiment of the disclosure, the front cover, the top cover, and the base forming the cabinet are separately formed and assembled to each other, but the disclosure is not limited thereto. For example, at least a portion of the front cover, the top cover, and the base may be integrally formed with each other.

The clothes dryer 1 may include the door 40 configured to open and close the inlet 12*a* formed by opening the front cover 12. After a user opens the door 40, the user can insert or withdraw laundry into or from the drum 20 through the inlet 12*a*.

The drum 20 may be arranged inside the cabinet 10 so as to be rotatable about a rotating axis that is provided substantially horizontally with the ground. The drum 20 may have a substantially cylindrical shape in which an opening is formed on front and rear surfaces, respectively. The front surface of the drum 20 may be provided with an inlet member 23 including an opening through which an object to be dried is inserted or withdrawn.

A lifter 21 may be provided on an inner peripheral surface of the drum 20 to lift clothes in response to a rotation of the drum 20. As the drum 20 rotates, the rise and fall of the clothes by the lifter 21 may be repeated. A roller 22 provided to support the drum 20 to allow the drum 20 to rotate smoothly may be provided on an outer peripheral surface of the drum.

The drum 20 may be installed to be rotated by receiving power by the driving device. The driving device may be arranged at an inner lower portion of the cabinet 10. The driving device may be mounted to the base 14.

The driving device may include a motor 70, and a pulley 72 and a belt 73 which are to transmit the power of the motor 70 to the drum 20. The pulley 72 may be connected to a rotating shaft 71 connected to the motor 70. In response to the rotation of the rotating shaft 71 by the motor 70, the pulley 72 may be rotated together with the rotating shaft 71. The belt 73 may be installed to be wound around an outer surface of the pulley 72 and an outer surface of the drum 20. In response to the rotation of the belt 73 by a driving force of the motor 70, the drum 20 may be rotated together with the belt 73.

The drum 20 is provided to accommodate an object to be dried therein, so as to dry the object. A flow path 80 provided to circulate dry air to the drum 20 may be formed in the cabinet 10. In addition, a blower fan 63 may be arranged at a lower rear side of the cabinet 10 to move air along the flow path 80.

The flow path 80 may include a discharge flow path 81 provided to discharge air from an inside of the drum 20 to an outside of the drum 20, a connection flow path 82 provided to dry the air discharged from the drum 20, and a supply flow path 83 provided to supply the dry air to the inside of the drum 20.

A filter 85 may be arranged on the discharge flow path 81 so as to filter out foreign substances contained in the air inside the drum 20. Heat exchangers 61 and 62 may be continuously arranged in the connection flow path 82. Air may become hot and dry while passing through the connection flow path 82. The air, in which foreign substances are filtered out and that becomes hot and dry while passing through the discharge flow path 81 and the connection flow path 82, may be supplied back into the drum 20 through the supply flow path 83. The clothes inside the drum 20 may be dried by the hot and dry air. The air drying the clothes may become a high-temperature and high-humidity state, and the high-temperature and high-humidity air in the drum 20 may be discharged to the outside of the drum 20 through the discharge flow path 81.

The clothes dryer 1 may dry the clothes inside the drum 20 while repeating the above process.

Figure 3:
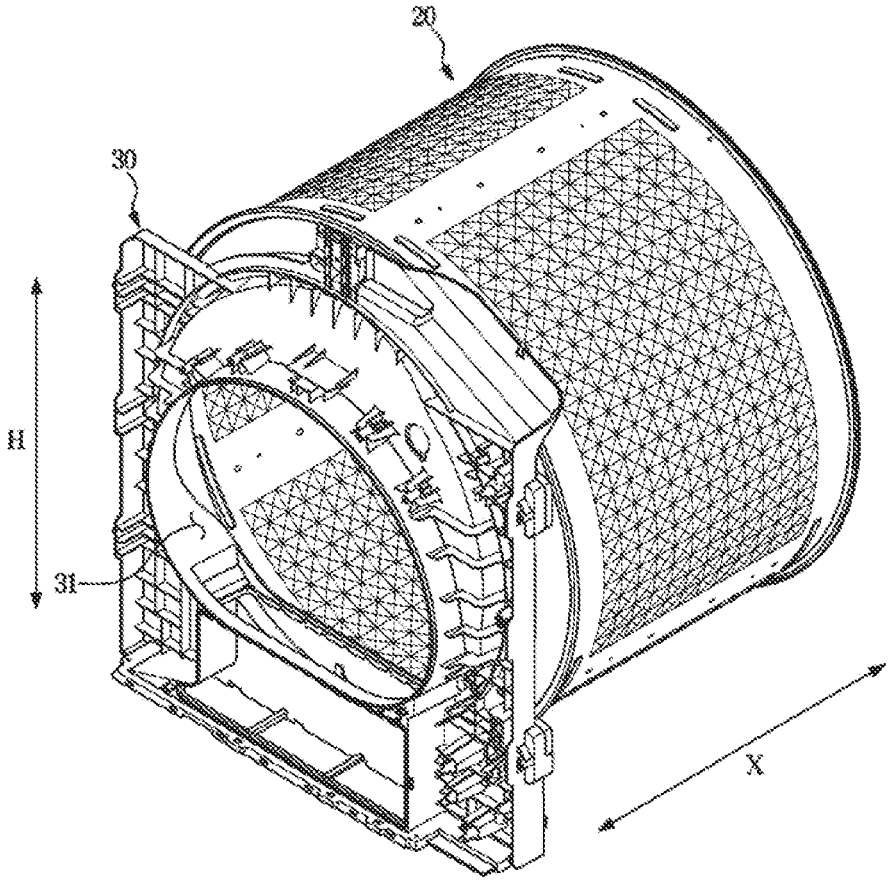
FIG. 3 is a view illustrating a state in which a frame, a gasket, and a drum of the clothes dryer according to an embodiment of the disclosure are coupled to each other.
Figure 4:
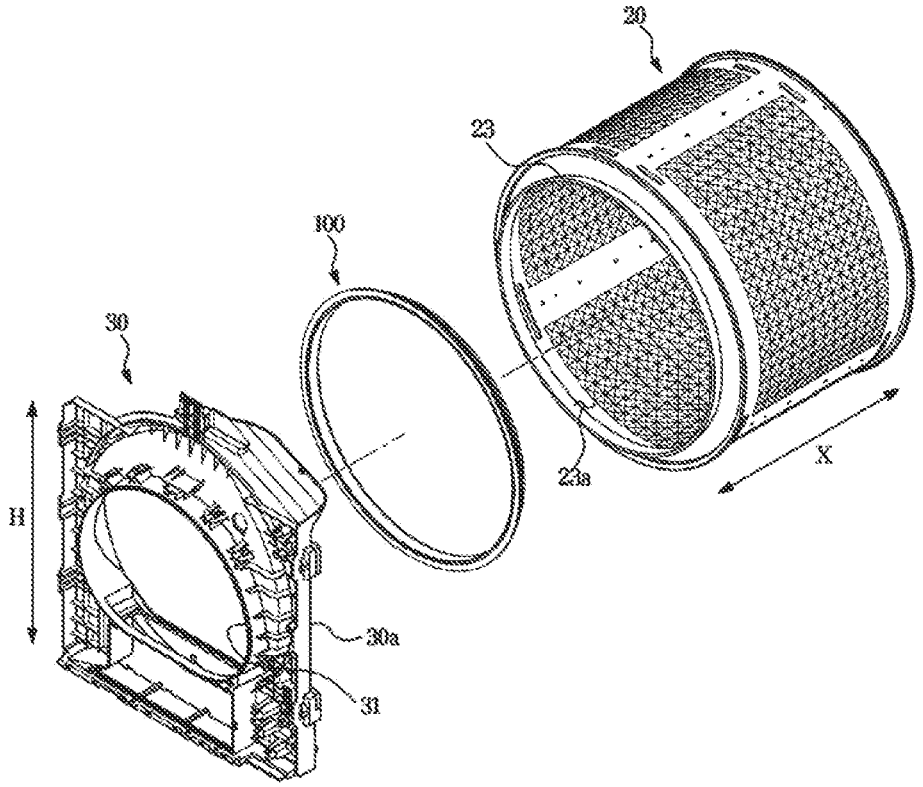
FIG. 4 is an exploded perspective view illustrating the frame, the gasket and the drum according to an embodiment of the disclosure.
Figure 5:
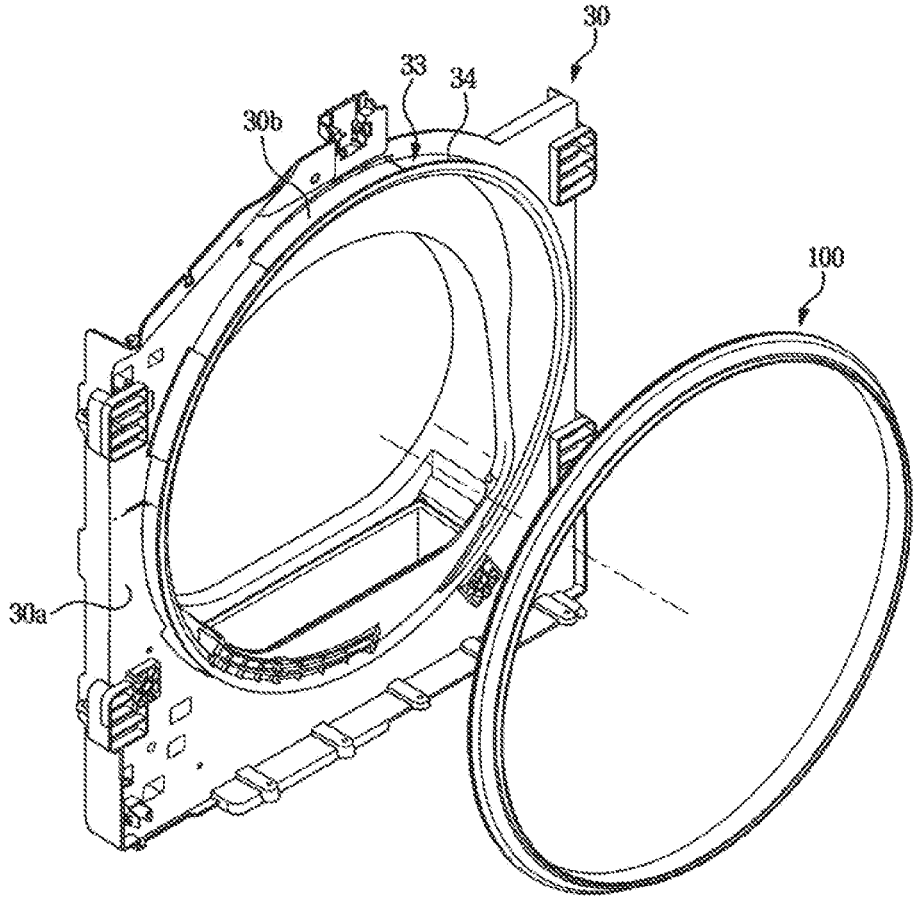
FIG. 5 is an exploded perspective view illustrating the frame and the gasket according to an embodiment of the disclosure.

FIG. 3 is a view illustrating a state in which a frame, a gasket, and a drum of the clothes dryer according to an embodiment of the disclosure are coupled to each other, FIG. 4 is an exploded perspective view illustrating the frame, the gasket and the drum according to an embodiment of the disclosure, and FIG. 5 is an exploded perspective view illustrating the frame and the gasket according to an embodiment of the disclosure.

As illustrated in FIGS. 3 to 5, the clothes dryer 1 may further include a support frame 30 provided to support the drum 20. The support frame 30 may be arranged between the cabinet 10 and the drum 20. The support frame 30 may include a front frame 30 provided to rotatably support a front end 23*a* of the drum 20 and a rear frame 30*c* provided to rotatably support a rear end of the drum 20. The front end 23*a* of the drum 20 may be used as a term referring to the same configuration as the inlet member 23 of the drum 20 to be described later.

The front frame (hereinafter, referred to as a frame 30) may be fixedly installed on the front cover 12 of the cabinet 10. The frame 30 may include a plate-shaped vertical surface 30*a* formed in a height direction H of the clothes dryer 1. The height direction H of the clothes dryer 1 may be used as a term referring to the same configuration as a vertical direction H of the drum 20.

The frame 30 may include at least one or more vertical surfaces 30*a*. The frame 30 may further include a horizontal surface 30*b* formed in a rotation axis direction X of the drum 20. The rotation axis direction X of the drum 20 may be used as a term referring to the same configuration as the front and rear direction X of the drum 20. The horizontal surface 30*b* of the frame 30 may include at least one surfaces. The horizontal surface 30*b* of the frame 30 may include all surfaces formed on the frame 30 and having the front and rear direction X of the drum 20. The frame 30 may include a plurality of vertical surfaces 30*a* and a plurality of horizontal surfaces 30*b*. The frame 30 may be arranged between the cabinet 10 and the drum 20 to support the drum 20.

A laundry inlet 31 may be formed in the frame 30. The laundry inlet 31 may be positioned to correspond to the inlet 12*a* formed in the front cover 12. An object to be dried may be put into the drum 20 through the laundry inlet 31.

The clothes dryer 1 may further include a gasket 100 arranged between the drum 20 and the frame 30 to maintain airtightness between the drum 20 and the frame 30.

When sealing between the drum 20 and the frame 30 is not performed properly, lint or water vapor that may be generated in the process of drying the object to be dried may leak through a gap between the drum 20 and the frame 30. The lint or water vapor may not only reduce the drying performance of the clothes dryer 1 but also cause safety accidents such as fire. Therefore, it is required to secure the airtightness between the drum 30 and the frame 30 by using the gasket 100.

The gasket 100 may not only maintain the airtightness between the drum 20 and the frame 30, but also reduce a frictional resistance between the drum 20 and the frame 30.

The gasket 100 may be arranged between the drum 20 and the frame 30. The gasket 100 may be coupled to the frame 30 so as to seal between the drum 20 and the frame 30.

The frame 30 may include a gasket mounting member 33 provided to allow the gasket 100 to be mounted thereon. The gasket mounting member 33 may extend from the frame 30 toward the drum 20 in the rotation axis direction X of the drum 20. The gasket mounting member 33 may have a shape corresponding to the gasket 100. As an example, the gasket mounting member 33 may be formed in an annular shape to allow the annular gasket 100 to be mounted thereto. The gasket mounting member 33 may include a flat surface so as to be in surface contact with at least a portion of the gasket 100. The gasket mounting member 33 may include a flat surface so as to be in surface contact with a second member 120 of the gasket 100. A detailed description of the gasket 100 will be described later (refer to FIG. 5).

The frame 30 may further include a separation prevention member 34 protruding from the gasket mounting member 33 to prevent the gasket 100 from being separated from the gasket mounting member 33. The separation prevention member 34 may be formed to protrude from the gasket mounting member 33 by a predetermined height in the height direction H of the clothes dryer 1. The separation prevention member 34 may be formed to extend in the height direction H of the clothes dryer 1. The gasket 100 may be installed to be mounted on the gasket mounting member 33, and may not be separated from the gasket mounting member 33 by the separation prevention member 34.

Figure 6:
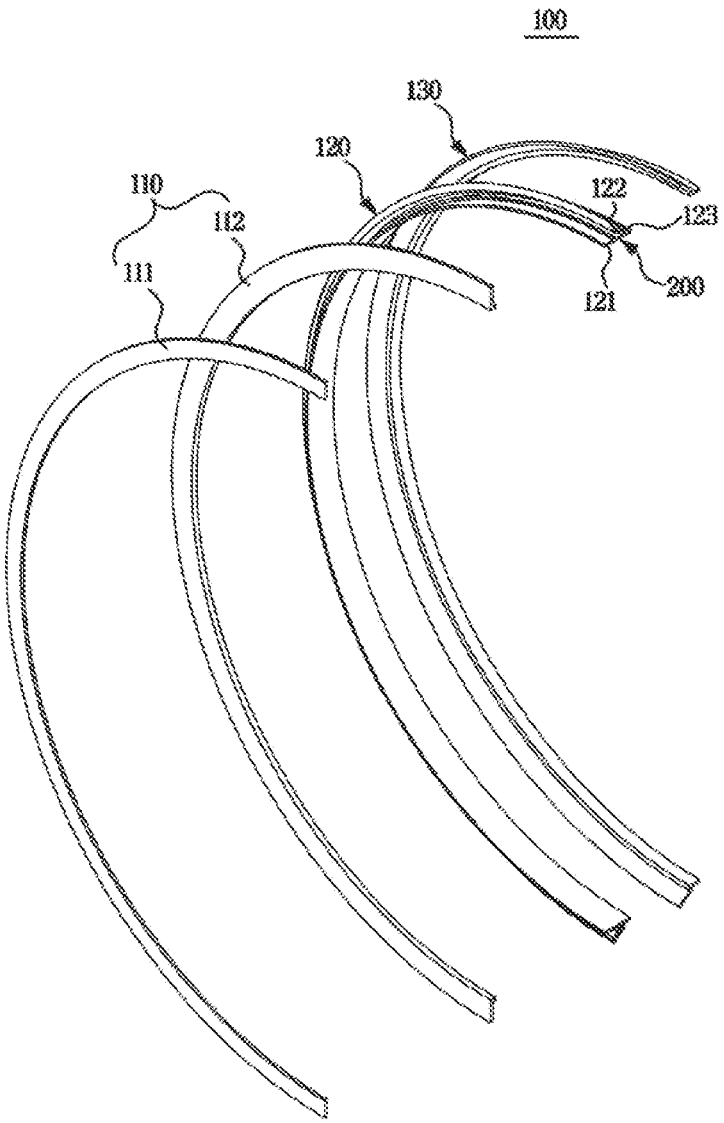
FIG. 6 is an exploded perspective view illustrating the gasket of the clothes dryer according to an embodiment of the disclosure.
Figure 7:
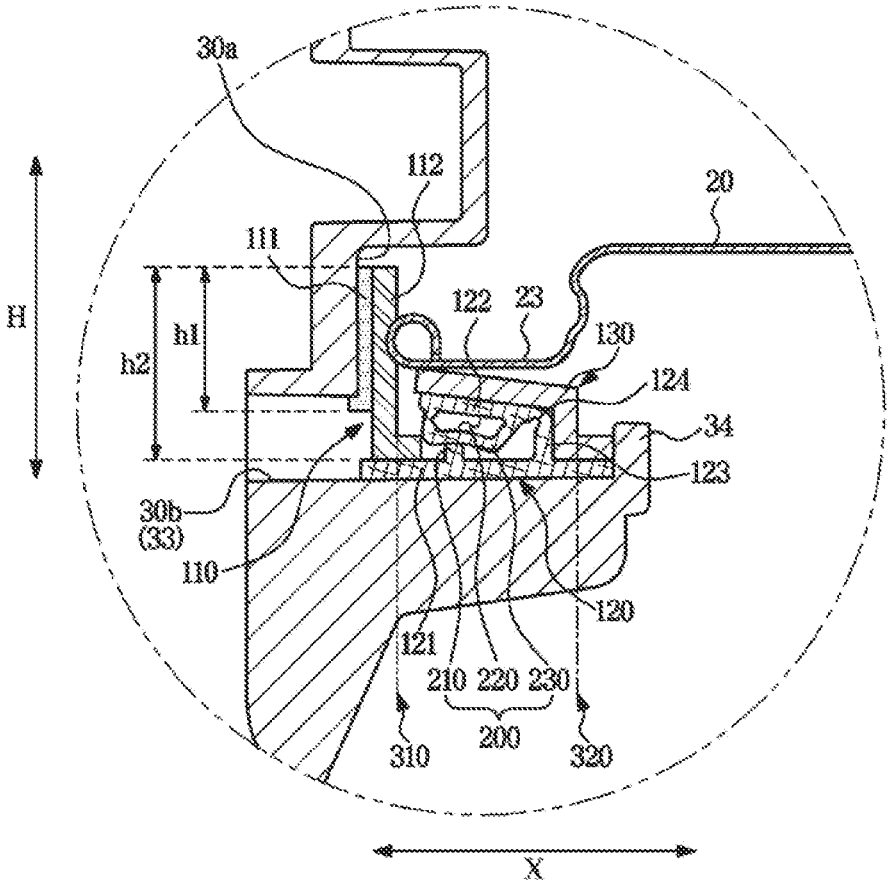
FIG. 7 is an enlarged view of a part A of FIG. 2, particularly illustrating a coupling state of the frame, the gasket and the drum according to an embodiment of the disclosure.

FIG. 6 is an exploded perspective view illustrating the gasket of the clothes dryer according to an embodiment of the disclosure, and FIG. 7 is an enlarged view of a part A of FIG. 2, particularly illustrating a coupling state of the frame, the gasket and the drum according to an embodiment of the disclosure.

As illustrated in FIGS. 6 and 7, the gasket 100 may be provided to maintain the airtightness between the drum 20 and the frame 30. The gasket 100 may be coupled to the frame 30 to seal between the drum 20 and the frame 30.

The gasket 100 may be formed in a closed loop shape. The gasket 100 may be formed in an annular shape. The gasket 100 may include a first member 110 and the second member 120 connected to the first member 110.

The first member 110 may be provided to allow the inlet member 23 of the drum 20 to be in contact with the frame 30 so as to limit the movement of the drum 20 in the front and rear direction X of the drum 20, that is, the rotation axis direction X of the drum 20. Particularly, the first member 110 may be coupled to the frame 30. The first member 110 may be in contact with the vertical surface 30*a* of the frame 30. The first member 110 may include a first pad 111 provided to be in contact with the vertical surface 30*a* of the frame 30 and a second pad 112 provided to be coupled to the first pad 111. The first pad 111 may include at least one of elastic rubber, ethylene propylene diene monomer (EPDM) rubber, and silicone rubber. The first pad 111 may be formed in an annular shape. Further, the first pad 111 may include an annular strip or band. The first pad 111 may have a first height h1. The first pad 111 may be coupled to at least a portion of the second pad 112. The first pad 111 may be attached to the front of the second pad 112. The first pad 111 may be coupled to the second pad 112 by an adhesive method.

The second pad 112 is provided to be coupled to the first pad 111. The second pad 112 may include a fabric material. For example, the second pad 112 corresponding to a component in friction with the rotating body may include a wool blend fabric having a small coefficient of friction and a sealing property. The second pad 112 may be formed in an annular shape. The second pad 112 may include an annular strip or band. The second pad 112 may have a second height h2. The first pad 111 may be attached to a front surface of the second pad 112. The second pad 112 may include a first connection member 310 to be coupled to the second member 120. The first connection member 310 may be provided to connect the first member 110 to the second member 120. The first connection member 310 may be provided to connect the second pad 112 to the second member 120. The first connection member 310 may include a connection method such as stitching. A method of connecting the first member 110 to the second member 120 is not limited to the above example and may vary.

The second member 120 of the gasket 100 may be provided to allow the inlet member 23 of the drum 20 to be elastically supported on the horizontal surface 30*b* of the frame 30 so as to limit the vertical movement of the drum 20, that is the height direction H of the clothes dryer 1. Particularly, the second member 120 may be coupled to the horizontal surface 30*b* of the frame 30. The second member 120 may be coupled to the gasket mounting member 33 of the frame 30. The second member 120 may include at least one of elastic rubber, EPDM rubber, and silicone rubber. The second member 120 may include an elastic material. The second member 120 may include a first body 121 provided to be in contact with the frame 30 and a second body 122 extending from the first body 121 to be foldable. The first body 121 of the second member 120 may be coupled to the horizontal surface 30*b* of the frame 30. The first body 121 of the second member 120 may be coupled to the gasket mounting member 33 of the frame 30.

The second member 120 may further include a connection body 123 provided to connect between the first body 121 and the second body 122. The connection body 123 may be formed to extend upwardly from the first body 121. The first body 121 and the second body 122 may be connected to each other in a foldable manner by the connection body 123. The second body 122 may be provided to be foldable on an upper side of the first body 121. The first body 121 and the second body 122 may be connected to each other to be foldable by a hinge 124. The hinge 124 may be provided on the connection body 123. Particularly, the first body 121 and the second body 122 of the second member 120 may be folded by the hinge 124 in response to the drum 20 being coupled to the frame 30.

The second member 120 may further include a hollow member 200 provided to maintain a reaction force of the drum 20. The second member 120 may further include the hollow member 200 provided to maintain a vertical reaction force of the drum 20 that is a reaction force in the height direction H of the clothes dryer 1.

The hollow member 200 may be arranged between the first body 121 and the second body 122. The hollow member 200 may include a protrusion 210 provided on the first body 121 and a hollow body 230 provided on the second body 122. The protrusion 210 may be formed to protrude upward of the first body 121. The protrusion 210 may be formed to protrude from an upper surface of the first body 121 in the height direction H of the clothes dryer 1.

The hollow body 230 may be formed to extend from the second body 122. The hollow body 230 may be provided to allow a hollow 220 to be formed therein. The hollow body 230 may be integrally extended to a lower side of the second body 122 to allow the hollow 220 to be provided at the lower side of the second body 122. The hollow body 230 may be formed at a position corresponding to the protrusion 210. The hollow body 230 and the protrusion 210 may be positioned between the first body 121 and the second body 122. In the embodiment of the disclosure, the hollow body 230 is illustrated as having a rectangular shape, but the disclosure is not limited thereto. For example, the hollow body may include a circular or polygonal shape.

The hollow member 200 may be provided in such a way that the protrusion 210 of the first body 121 presses the hollow body 230 of the second body 122 when the second body 122 and the first body 121 of the second member 120 are folded in response to the drum 20 being coupled to the frame 30. By using the air of the hollow 220, the hollow 220 of the hollow body 230 may limit the movement of the drum 20 in the vertical direction H of the drum 20. In the operation of the clothes dryer 1, the air inside the hollow 220 of the hollow member 200 may be heated and expanded at the same time. By the hollow 220 of the hollow member 200, the movement of the drum 20 in the vertical direction H of the drum 20 may be limited, and the sealing property of the gasket 100 may be further improved.

The gasket 100 may further include a third member 130 connected to the second member 120 and provided to be supported in contact with at least any part of the inner surface of the drum 20. The third member 130 may be coupled to the first body 121 of the second member 120. The third member 130 may include a fabric material. For example, the third member 130 corresponding to a component in friction with the rotating body may include a wool blend fabric having a small coefficient of friction and a sealing property. The third member 130 may be formed in an annular shape. The third member 130 may include an annular strip or band. The third member 130 may be connected to the first body 121 of the second member 120. The third member 130 may be coupled to the first body 121 through a second connection member 320. The second connection member 320 may be sewn to the first body 121 to allow one side of the third member 130 to be fixed to the first body 121. In the embodiment of the disclosure, the second connection member is illustrated as a stitching method between the third member and the first body, but the disclosure is not limited thereto. A connection method between the third member and the first body may vary. The second connection member 320 may be located behind the first connection member 310. The first connection member 310 may be located in the front with respect to the rotation axis direction X of the drum 20 and the second connection member 320 may be located behind the first connection member 310 with respect to the rotation axis direction X of the drum 20.

The third member 130 may be coupled to the second body 122 of the second member 120. The third member 130 may be provided to overlap the upper surface of the second body 122. The third member 130 may be provided on the upper surface of the second body 122 to be in surface contact with the inner surface of the drum 20. The third member 130 may be in surface contact with at least a portion of the inner surface of the drum 20 to maintain the seal with the inner surfaces of the drum 20 and, simultaneously, to minimize the resistance caused by the contact between the gasket 100 and the inner surface of the drum 20. Further, the third member 130 may limit the movement of the drum 20 in the vertical direction H of the drum 20 so as to increase a response force to the movement of the drum 20.

Figure 8:
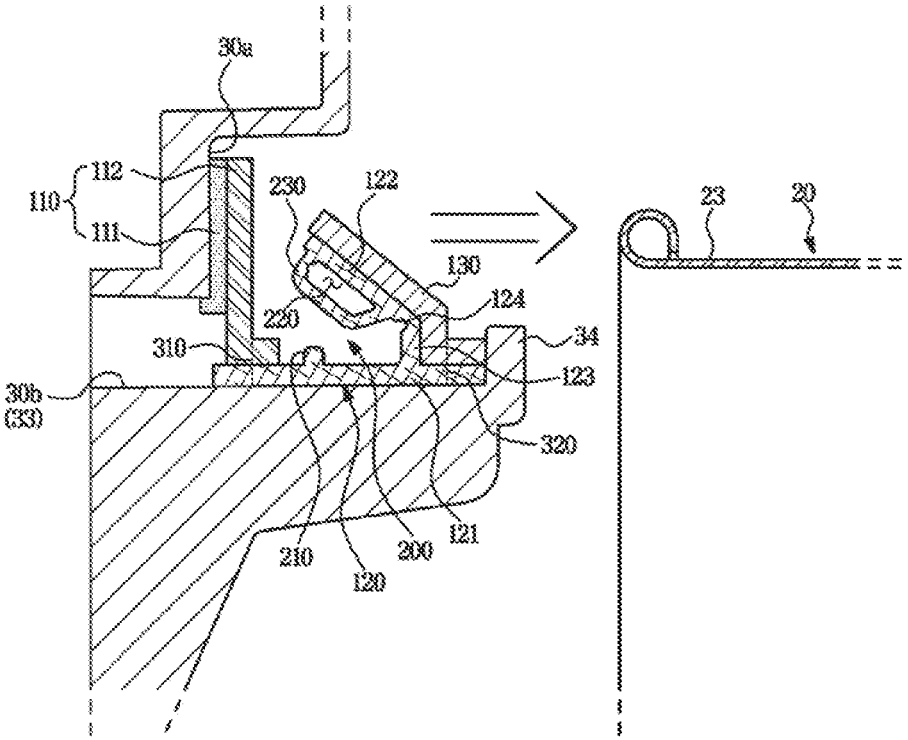
FIG. 8 is a view illustrating a state before a front support frame and the gasket, and the drum of the clothes dryer according to an embodiment of the disclosure are coupled to each other.
Figure 9:
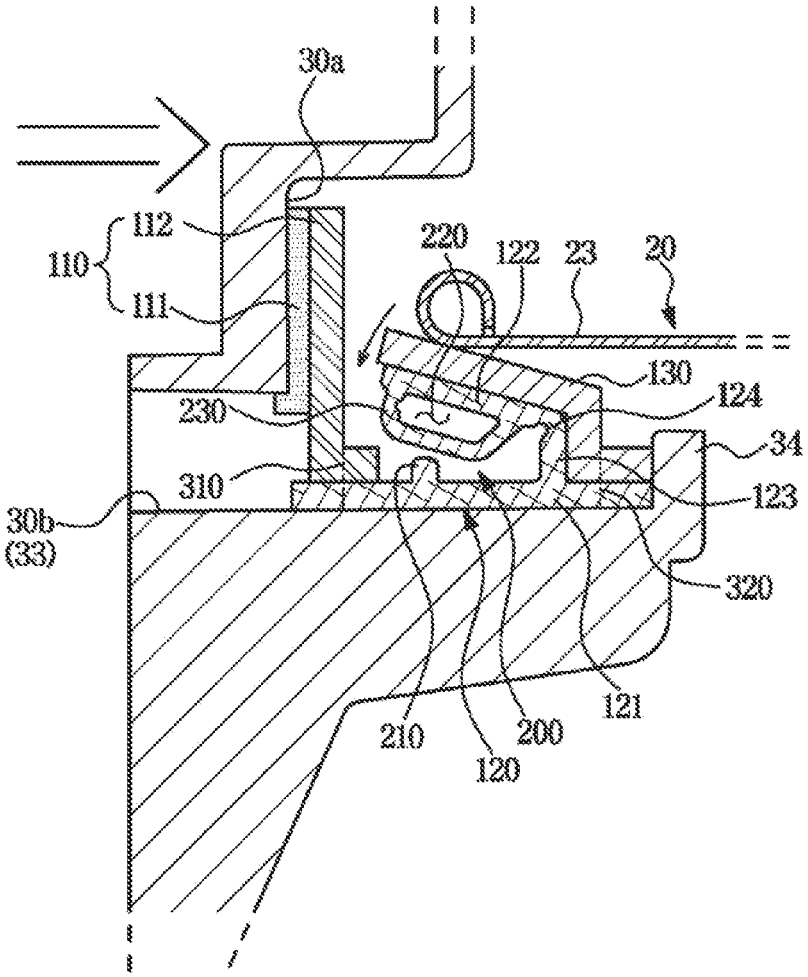
FIG. 9 is a view illustrating a state in which the front support frame and the gasket, and the drum of the clothes dryer according to an embodiment of the disclosure are coupled to each other.
Figure 10:
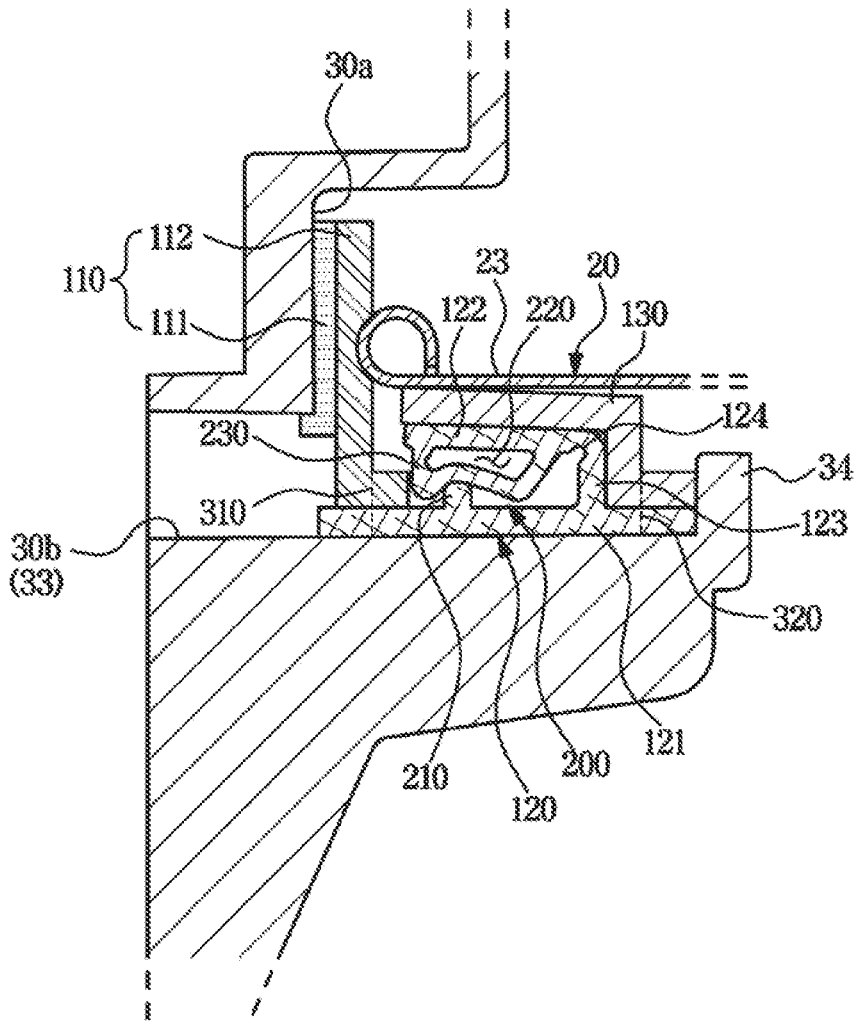
FIG. 10 is a view illustrating a change in the gasket and the drum according to a movement of the drum according to an embodiment of the disclosure.

FIG. 8 is a view illustrating a state before a front support frame and the gasket, and the drum of the clothes dryer according to an embodiment of the disclosure are coupled to each other, FIG. 9 is a view illustrating a state in which the front support frame and the gasket, and the drum of the clothes dryer according to an embodiment of the disclosure are coupled to each other, and FIG. 10 is a view illustrating a change in the gasket and the drum according to a movement of the drum according to an embodiment of the disclosure.

As illustrated in FIGS. 8 to 10, before the drum 20 of the clothes dryer 1 is coupled to the frame 30, the first pad 111 of the first member 110 of the gasket 100 may be coupled to the vertical surface 30*a* of the frame 30.

As for the second member 120, which is bent and connected to the second pad 112 of the first member 110 by the first connection member 310, the first body 121 may be mounted to the gasket mounting member 33 of the frame 30, and the second body 122 may be inclined at a predetermined angle with respect to the first body 121 by the connection body 123, so as to be positioned on the upper side of the first body 121. At this time, the third member 130 is provided on the upper surface of the second body 122.

Before the drum 20 and the frame 30 are coupled to each other, the hollow 220 of the hollow member 200 formed between the first member 110 and the second member 120 of the gasket 100 maintains a circular shape.

In response to the drum 20 being coupled to the frame 30, the inner surface of the drum 20 presses at least a part of the third member 130, and the second body 122 of the second member 120 arranged below the third member 130 is moved downward. The second member 120 may be rotated and folded by the hinge 124 formed on the connection body 123.

The drum 20 may be in surface contact with the second member 120, that is, the upper surface of the third member 130 of the gasket 100.

The second body 122 of the second member 120 may be moved downward by the pressure of the drum 20, and the hollow body 230 formed under the second body 122 may be pressed by the protrusion 210 of the first body 121 so as to allow the hollow 220 formed therein to be pressed. The rotating drum 20 may be moved in the vertical direction H or the front and rear direction X. The movement of the drum 20 in the vertical direction H may be limited by the second member 120 in surface contact with the inner surface of the drum 20, and by the hollow member 200. By the hollow member 200 of the gasket 100, the drum 20 may maintain a predetermined reaction force.

Further, the inlet member 23 of the drum 20 may be in line contact with the first member 110 of the gasket 100. The movement in the front and rear direction X of the drum 20 may be limited by the first member 110 of the gasket 100 in contact with the inlet member 23 of the drum 20.

As described above, the gasket 100 may maintain the seal between the drum 20 and the gasket 30 by using the first member 110 formed in the vertical direction of the frame 30 so as to limit the movement of the front and rear direction X of the drum 20 and by using the second member 120 formed in the horizontal direction of the frame 30 so as to limit the movement of the vertical direction H of the drum 20. Further, the gasket 100 may maintain a predetermined reaction force of the drum 20 by using the hollow member 200 formed in the gasket 100.

As is apparent from the above description, a sealing gasket for a clothes dryer may reduce heat loss and dust leakage caused by lint and water vapor that are generated inside a drum and leak to an outside of the drum.

Further, because a gasket is in surface contact with a drum and the gasket is in line contact with a front frame, it is possible to maintain airtightness between the drum and the front frame with respect to a vertical direction and a horizontal direction, and at the same time, it is possible to minimize a resistance caused by the contact between the drum and the front frame.

Further, it is possible to increase airtightness between a drum and a gasket by using the gasket including an elastic material and a fabric material.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes dryer comprising:

a cabinet;

a drum rotatable inside the cabinet;

a frame positionable between the cabinet and the drum to support the drum; and a gasket positionable between the drum and the frame, wherein the gasket comprises:

a first member to couple an inlet member of the drum to a vertical surface of the frame while the first member is in contact with the vertical surface of the frame so as to limit a horizontal movement of the drum, wherein the inlet member is provided on a front surface of the drum; and a second member to couple the inlet member of the drum to a horizontal surface of the frame while the second member elastically supports the inlet member of the drum on the horizontal surface of the frame so as to limit a vertical movement of the drum.

2. The clothes dryer of claim 1, wherein the first member comprises:

a first pad configured to couple to the frame, the first pad comprising at least one of elastic rubber, ethylene propylene diene monomer (EPDM) rubber, and silicone rubber; and a second pad configured to couple to the first pad to allow a front face of the drum to be in contact therewith and comprising a fabric material.

3. The clothes dryer of claim 2, wherein the first pad and the second pad are configured to couple to each other by an adhesive method.

4. The clothes dryer of claim 1, wherein the second member comprises at least one of elastic rubber, EPDM rubber, and silicone rubber.

5. The clothes dryer of claim 1, wherein the second member comprises:

a first body to be in contact with the horizontal surface of the frame; and a second body which extends from the first body, wherein the second body is above the first body and is moveable relative to the first body.

6. The clothes dryer of claim 5, wherein the second member further comprises a hollow member which is positionable between the first body and the second body, while the first member is in contact with the vertical surface of the frame and the second member supports the inlet member of the drum, to maintain a reaction force of the drum.

7. The clothes dryer of claim 6, wherein the hollow member comprises:

a protrusion formed on at least one of the first body and the second body; and a hollow body, on at least another of the first body and the second body to face the protrusion, and comprising a hollow formed in the hollow body.

8. The clothes dryer of claim 7, wherein the second member comprises a hinge to allow the first body and the second body to be connected to each other and to allow the second body to move relative to the first body.

9. The clothes dryer of claim 8, wherein a third member is arranged to overlap an upper surface of the second body.

10. The clothes dryer of claim 9, wherein the first member is coupleable to the second member through a first connection member, wherein the first connection member enables the second body to move relative to the first body.

11. The clothes dryer of claim 10, wherein the third member is coupleable to the second member through a second connection member, wherein the second connection member enables the second body to move relative to the first body, and the second connection member is behind the first connection member along a rotation axis direction of the drum.

12. The clothes dryer of claim 8, wherein the second member further comprises a connection body which extends upwardly from the first body to connect between the first body and the second body, wherein the hinge is provided on the connection body.

13. The clothes dryer of claim 1, wherein the gasket further comprises a third member to be connected to the second member and be supported in surface contact with at least a portion of an inner surface of the drum, wherein the third member comprises a fabric material.

14. The clothes dryer of claim 1, wherein the frame further comprises:

a gasket mounting member to which the gasket is mountable; and a separation prevention member which protrudes from the horizontal surface of the frame to prevent the gasket from being separated from the gasket mounting member.

* * * * *